US010487461B2

(12) United States Patent
Budzianowski et al.

(10) Patent No.: US 10,487,461 B2
(45) Date of Patent: Nov. 26, 2019

(54) ECCENTRIC ASSEMBLY FOR OSCILLATING A COMPACTING DRUM OF A COMPACTING MACHINE

(71) Applicant: VOLVO CONSTRUCTION EQUIPMENT AB, Eskilstuna (SE)

(72) Inventors: Dobromil Budzianowski, Sieradz (PL); Krzysztof Biaduń, Polkowice (PL)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 16/094,026

(22) PCT Filed: Apr. 21, 2016

(86) PCT No.: PCT/EP2016/058853
§ 371 (c)(1),
(2) Date: Oct. 16, 2018

(87) PCT Pub. No.: WO2017/182079
PCT Pub. Date: Oct. 26, 2017

(65) Prior Publication Data
US 2019/0112768 A1 Apr. 18, 2019

(51) Int. Cl.
*E01C 19/28* (2006.01)
*B06B 1/16* (2006.01)

(52) U.S. Cl.
CPC ..... *E01C 19/286* (2013.01); *B06B 1/16* (2013.01)

(58) Field of Classification Search
CPC .... E01C 19/286; E01C 19/287; E01C 19/288; F16C 3/18; B06B 1/16
See application file for complete search history.

(56) References Cited

U.S. PATENT DOCUMENTS 3,896,677 A * 7/1975 Larson ..... B06B 1/162 74/61
3,909,147 A * 9/1975 Takata ..... B06B 1/162 404/117

(Continued)

FOREIGN PATENT DOCUMENTS

EP 0053598 A1 6/1982

OTHER PUBLICATIONS

International Search Report (dated Sep. 8, 2016) for corresponding International App. PCT/EP2016/058853.

*Primary Examiner* — Abigail A Risic
(74) *Attorney, Agent, or Firm* — Sage Patent Group

(57) ABSTRACT

An eccentric assembly for oscillating a compacting drum of a compacting machine includes: a central disk rotatably mounted to the compacting drum to have an axis disposed in juxtaposition with an axis of the compacting drum, and configured to be rotatably driven by a motor; a pair of opposed eccentric shafts, each axis of which is disposed equidistantly from the center of the axis of the central disk, the eccentric shafts being rotatably mounted to the compacting drum such that the three axes of the central disk and the eccentric shafts are in the same plane; and yoke disposed between the central disk and the two eccentric shafts in such a manner as to be connected to the central disk and the two eccentric shafts, respectively, by means of three connecting members. One end of each of the connecting members is rotatably coupled to different positions of the yoke, and the other end thereof is fixed to a corresponding one of time central disk and the two eccentric shafts such that the two eccentric shafts rotate synchronously by the rotation of the central disk.

11 Claims, 6 Drawing Sheets

(56) References Cited

U.S. PATENT DOCUMENTS

| | | | | |
|---|---|---|---|---|
| 4,577,995 | A | 3/1986 | Sadahiro | |
| 5,618,133 | A * | 4/1997 | Mitsui | B06B 1/186 404/117 |
| 5,860,321 | A | 1/1999 | Williams et al. | |
| 6,224,293 | B1 * | 5/2001 | Smith | B06B 1/164 404/117 |
| 6,516,679 | B2 * | 2/2003 | Yates | B06B 1/164 404/117 |
| 10,072,386 | B1 * | 9/2018 | Lehtola | B06B 1/16 |
| 2002/0100339 | A1 * | 8/2002 | Yates | B06B 1/164 74/87 |
| 2006/0070469 | A1 | 4/2006 | Lester | |
| 2018/0216300 | A1 * | 8/2018 | Golbs | E01C 19/286 |
| 2019/0093299 | A1 * | 3/2019 | Meixner | B06B 1/16 |

* cited by examiner

【FIG. 1】
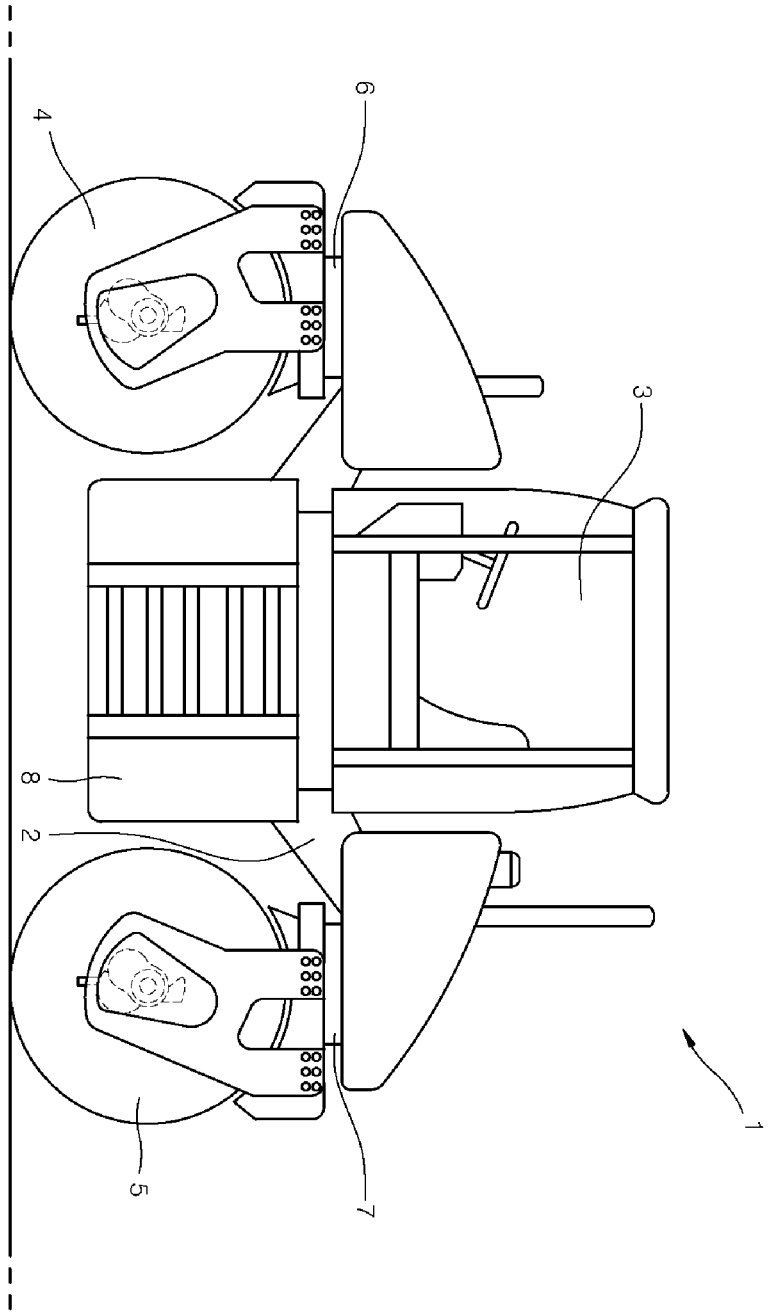

【FIG. 2】
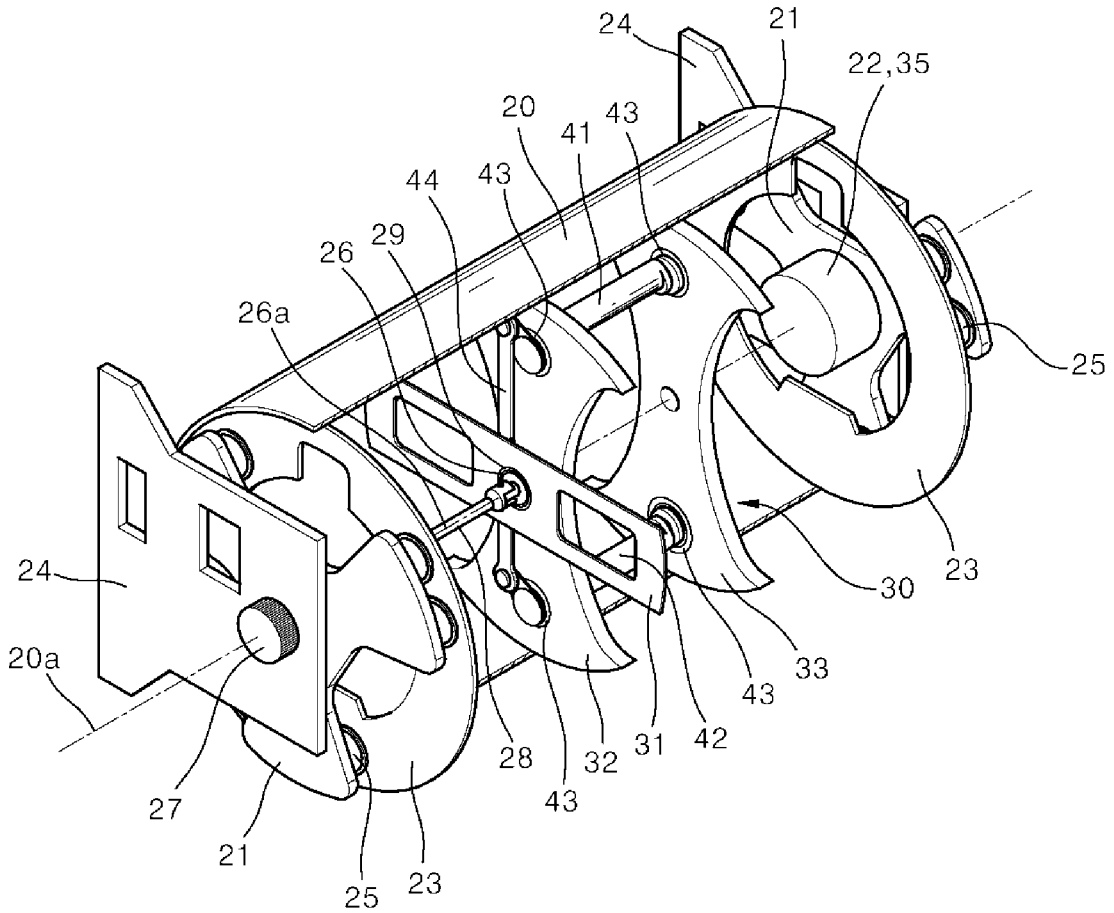

【FIG. 3】
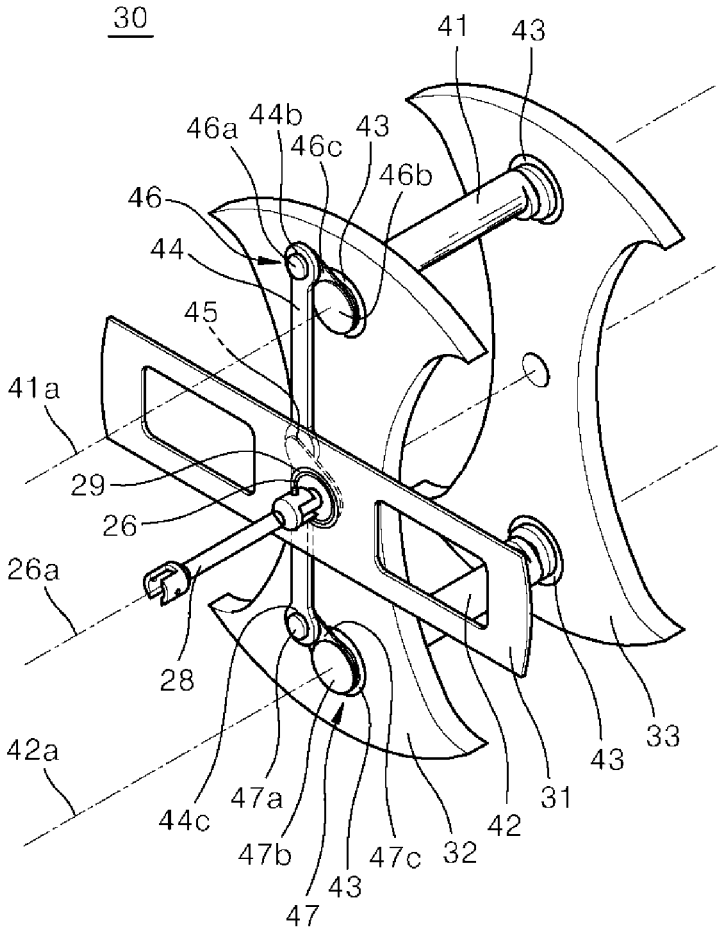

【FIG. 4】
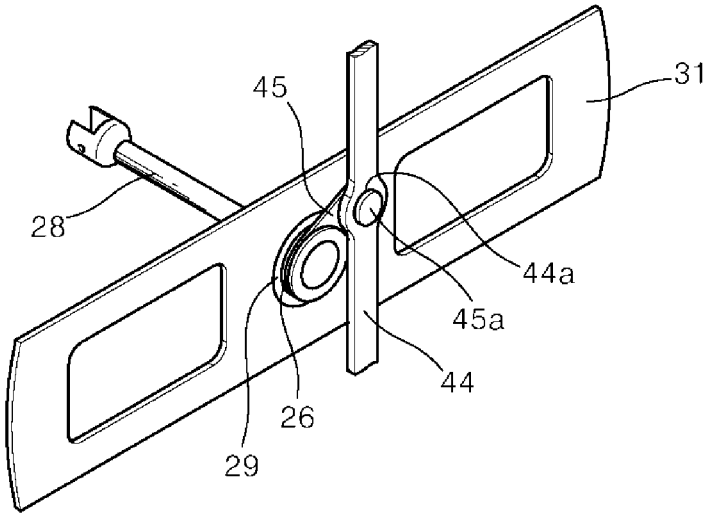

【FIG. 5】
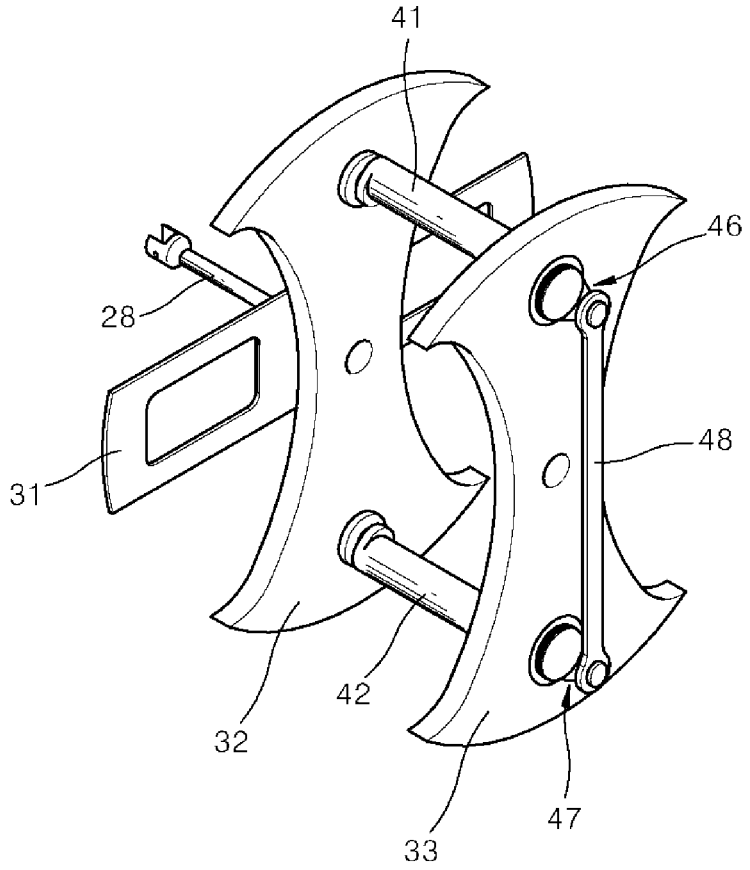
【FIG. 6】
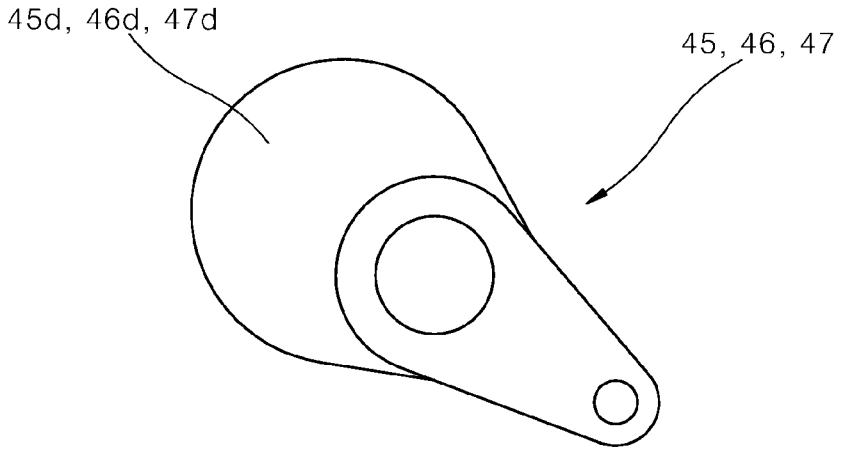

【FIG. 7】
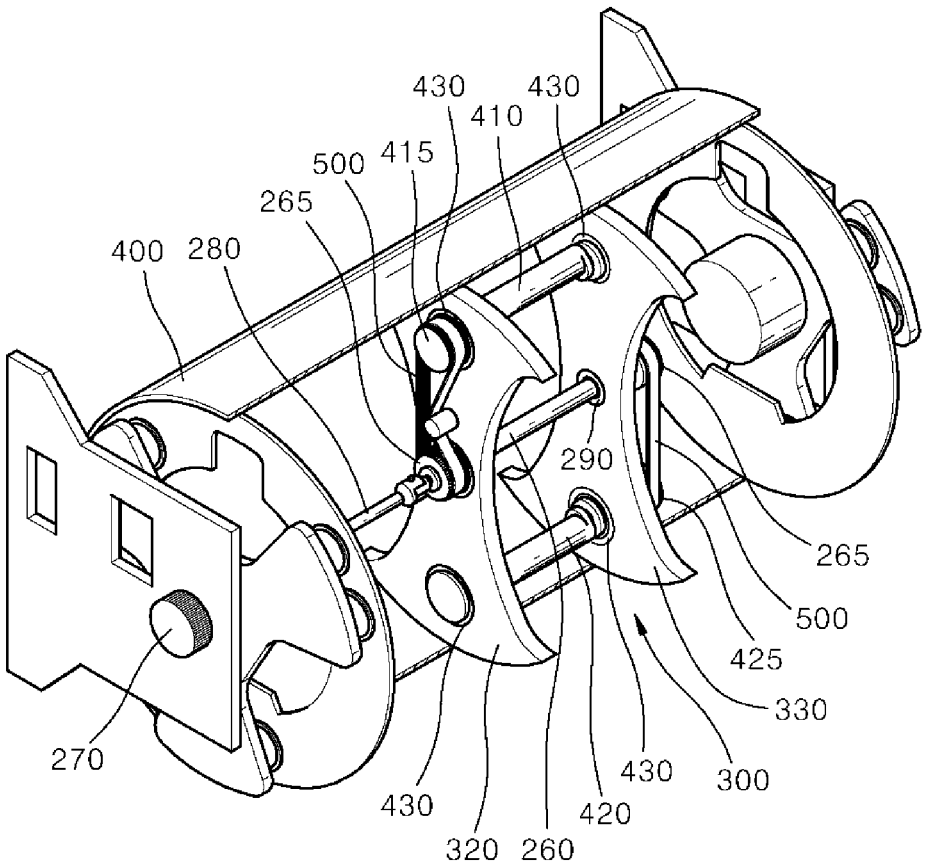

ECCENTRIC ASSEMBLY FOR OSCILLATING A COMPACTING DRUM OF A COMPACTING MACHINE

BACKGROUND AND SUMMARY

The present disclosure relates to compacting machines, and more particularly to an assembly for oscillating a compacting drum of a compacting machine.

Compacting machines are used in leveling paved or unpaved ground surfaces. A typical compacting machine includes an eccentric assembly, which is located inside a compacting drum of the compacting machine and generates vibrations or oscillations due to its eccentricity while being rotated by an electrical or hydraulic motor. Then, the vibrations or oscillations generated by the eccentric assembly are transferred to the compacting drum, thereby enhancing the compacting efficiency of the compacting machine.

An eccentric assembly for vibrating a compacting drum provides radial vibrations that periodically change the value of a normal contact force exerted to the ground by the compacting drum, whereas an eccentric assembly for oscillating the compacting drum does not provide radial vibrations but provide oscillations that change the torque that rotates the drum, and thus, periodically change a tangential contact force exerted to the ground by the drum. Due to the absence of vibrations in a normal direction, eccentric assemblies for oscillating can be used on constructions that are sensitive to normal vibrations such as bridges.

The eccentric assembly for oscillating has two eccentric shafts that are positioned at the same distance from a central shalt driven by a motor, and are rotated in the same direction synchronously driven by the central shaft. In most of currently available eccentric assemblies for oscillation, the two synchronously rotating eccentric shafts are driven via the central shaft by means of toothed belts.

FIG. 7 schematically shows the interior of a compacting drum including an eccentric assembly for oscillating the compacting drum according to the prior art.

Positioned at the center of the compacting drum 400 is an assembly 300 for oscillating a compacting machine. A central shaft 260 of the assembly is driven by a motor 270, such as a hydraulic or electric motor, via a driving shaft 280. The central shaft 260 is rotatably mounted to two section walls 320 and 330 fixed, e.g., welded to the compacting drum 400, with each end of the central shaft 260 supported by bearings 290. The driving shaft 280 is connected to the central shaft 260 and the motor 270 by means of articulated joints at both ends thereof to allow the compacting drum 400 to vibrate. Two eccentric shafts, a first eccentric shaft 410 and a second eccentric shaft 420, are also rotatably mounted to the two sections walls 320 and 330 with each ends of the eccentric shafts 410 and 420 supported by bearings 430. The two eccentric shafts 410 and 420 are disposed equidistantly from the central shaft 260 in parallel to the central shaft 260, and thus, the two eccentric shafts 410 and 420 and the central shaft 260 are generally in the same plane. A drive pulley 265 is mounted at both ends of the central shaft 260, respectively. A driven pulley 415 is mounted at one end of the first eccentric shaft 410, and a driven pulley 425 is mounted at an end of the second eccentric shaft 420, which is positioned farther away from the one end of the first eccentric shaft 410 where the driven pulley 415 is mounted. The drive pulley 265 and the driven pulleys 415 and 425 are connected to two toothed belts 500. Thus, the rotational energy of the central shaft 260 is transmitted to the two eccentric shafts 410 and 420 so that the two eccentric shafts 410 and 420 can synchronously rotate.

However, this constitution lacks in durability and requires frequent servicing of the machine. In other words, the toothed belts are wearable, resulting in a degradation in reliability and a reduction in lifetime. In addition, a replaced toothed belt is required to be discarded, and thus the conventional oscillation mechanism is not environment-friendly. Meanwhile, a conventional oscillation mechanism of using a gear mechanism exists instead of using the two toothed belts to transmit the rotational energy of the central shaft to the two eccentric shafts, but it is complicated in its structure and requires high cost. Further, such a conventional oscillation mechanism is totally different in structure from the conventional oscillation mechanism using the toothed belts as shown in FIG. 7, and thus it is impossible to simply improve the conventional oscillation mechanism as shown in FIG. 7 using the conventional oscillation mechanism of using a gear mechanism.

Therefore, there is a need for an eccentric assembly for oscillating a compacting drum of a compacting machine, which can provide greater reliability and much longer lifetime to allow less serviceability to be needed, can eliminate the necessity for wearable belts to make a design simple while offering a more environment-friendly solution, and can be easily implemented in the conventional compacting machine using the toothed belts.

According to one aspect of the present disclosure, there is provided an eccentric assembly for oscillating a compacting drum of a compacting machine. The eccentric assembly includes:

a central disk rotatably mounted to the compacting drum to have an axis disposed in juxtaposition with an axis of the compacting drum, and configured to be rotatably driven by a motor;

a pair of opposed eccentric shafts, each axis of which is disposed equidistantly from the center of the axis of the central disk, the eccentric shafts being rotatably mounted to the compacting drum such that the three axes of the central disk and the eccentric shafts are in the same plane; and a yoke disposed between the central disk and the two eccentric shafts in such a manner a to be connected to the central disk and the two eccentric shafts, respectively, by means of three connecting members.

One end of each of the connecting members is rotatably coupled to different positions of the yoke, and the other end thereof is fixed to a corresponding one of the central disk and the two eccentric shafts such that the two eccentric shafts rotate synchronously by the rotation of the central disk.

BRIEF DESCRIPTION OF THE DRAWINGS

FIG. 1 shows a compacting machine;

FIG. 2 is a schematic perspective view showing the interior of a compacting drum including an eccentric assembly for oscillating the compacting drum according to an embodiment of the present disclosure;

FIG. 3 is a perspective view showing an eccentric assembly for oscillating the comp6acting drum according to an embodiment of the present disclosure as shown in FIG. 2;

FIG. 4 is a perspective view showing an engagement structure between a yoke and a central disk in an eccentric assembly for oscillating the compacting drum according to an embodiment of the present disclosure;

FIG. 5 is a perspective view showing an eccentric assembly for oscillating the compacting drum according to an embodiment of the present disclosure when viewed from a direction opposite to the eye gaze direction of FIG. 3;

FIG. 6 is a plane view showing a connecting member in an eccentric assembly for oscillating the compacting drum according to another embodiment of the present disclosure; and FIG. 7 is a schematic perspective view showing the interior of a compacting drum including an eccentric assembly for oscillating the compacting drum according to the prior art.

DETAILED DESCRIPTION

Reference will now be made in detail to embodiments of the present disclosure, examples of which are illustrated in the accompanying drawings. While the present disclosure will be described in conjunction with the following embodiments, it will be understood that they are not intended to limit the present disclosure to these embodiments alone. On the contrary, the present disclosure is intended to cover alternatives, modifications, and equivalents which may be included within the spirit and scope of the present disclosure as defined by the appended claims. Furthermore, in the following detailed description of the present disclosure, numerous specific details are set forth in order to provide a thorough understanding of the present disclosure. However, embodiments of the present disclosure may be practiced without these specific details.

FIG. 1 shows a compacting machine 1 that includes a frame 2 with an operator's cab 3, a front compacting drum 4 and a rear compacting drum 5 each being mounted via a steerable swivel coupling 6 or 7 at the front and rear portions of the underside of the frame 2 respectively. Situated between the two compacting drums 4 and 5 is an engine compartment 8 which accommodates a drive engine, usually a diesel engine. Although the disclosure is focused on a compacting machine having two compacting drums and an operator's cab, it is equally applicable to compacting machines having a single compacting drum and or compacting machines that are pulled or pushed by other objects, such as a tractor or a human operator.

FIG. 2 shows a partially cut-away perspective view of one of the compacting drums 4 and 5 to show the eccentric assembly for oscillating within the compacting drum 4 or 5. The compacting drum 4 or 5 comprises a cylindrical wall 20 that contacts the ground. The cylindrical wall 20 is connected to structural support plates 23 and rotatably mounted by means of two outer radially extending plates 21. The radially extending plates 21 are mounted to the structural support plates 23 via vibration damping elements 25, such as rubber-metal elements. A motor 35, such as a hydraulic motor or a hydraulic motor combined with a gearbox, is fastened to a frame support member 24 to drive the compacting drum 4 or 5 of the compaction machine 1. Bearings 22 are integrated into the motor 35 and the radially extending plate 21 to allow for the rotation of the radially extending plates 21 and the cylindrical wall 20 relative to the frame support member 24 to drive the compaction machine 1.

Positioned in the center of the compacting drum 4 or 5 is an assembly 30 for oscillating the compacting machine 1, which is shown in more detail in FIG. 3. The assembly 30 for oscillating the compacting machine 1 is mounted within at least one compacting drum 4 or 5 of the compacting machine 1 and generates oscillations which are in turn transferred to the cylindrical wall 20 of the compacting drum 4 or 5. The assembly 30 comprises a central disk 26 driven by a motor 27, such as a hydraulic or electric motor, via a driving shaft 28. The driving shaft 28 is connected to the central disk 26 and the motor 27 by means of articulated joints at both ends thereof to allow the compacting drum 4 or 5 to oscillate.

The central disk 26 is rotatably mounted to the compacting drum 4 or 5. In the present disclosure, the central disk 26 is mounted to a bracket 31 supported by a bearing 29, such that the central disk 26 can rotate relative to the bracket 31. The bracket 31 is fixed relative to the cylindrical wall 20. That is, the bracket 31 is fixed directly to the cylindrical wall 20 or fixed to a member which is fixed to the cylindrical wall 20. FIG. 2 shows a state in which a bracket 31 extends in a radial direction of the compacting drum 4 or 5 and is joined to the inner peripheral surface of the cylindrical wall 20 by welding or the like.

The assembly 30 also comprises two eccentric shafts 41 and 42 that are rotatably mounted to the compacting drum 4 or 5. In the present disclosure, two section walls 32 and 33 are fixed, e.g., welded, to the inner peripheral surface of the cylindrical wall 20. The two eccentric shafts, a first eccentric shaft 41 and a second eccentric shaft 42, are mounted to the two sections walls 32 and 33 with each ends of the eccentric shafts 41 and 42 supported by bearings 43. FIG. 2 shows a state in which two section walls 32 and 33 extend in a radial direction of the compacting drum 4 or 5 and are joined to the inner peripheral surface of the cylindrical wall 20 by welding or the like.

As can be seen from FIG. 2, the axis 26*a* of the central disk 26 is substantially the same as the axis 20*a* of the compacting drum 4 or 5. As can be seen from FIG. 3, the two eccentric shafts 41 and 42 are disposed equidistantly from the axis 26*a* of the central disk 26, and the axes 41*a* and 42*a* of the two eccentric shafts 41 and 42 and the axis 26*a* of the central disk 26 are in the same plane. Unless otherwise specified, the term 'axis' refers to a rotational axis.

The assembly 30 also includes a yoke 44 connected to the central disk 26 and the two eccentric shafts 41 and 42 together so that the two eccentric shafts 41 and 42 rotate synchronously. The yoke 44 is interposed between the central disk 26 and the two eccentric shafts, and is connected to the central disk 26 and the two eccentric shafts 41 and 42, respectively, by means of three connecting members 45, 46 and 47. One end of each of the connecting members 45, 46 and 47 is rotatably coupled to different positions of the yoke 44, and the other end thereof is fixed to a corresponding one of the central disk 26 and the two eccentric shafts 41 and 42.

As shown in FIG. 3, a pin 46*a* is formed at one end of a connecting member 46 and a hole 44*b* is formed at one end of the yoke 44 so as to be engaged with the pin 46*a* so that the one end of the connecting member 46 is rotatably coupled to the yoke 44, and a pin 47*a* is formed at one end of a connecting member 47 and a hole 44*c* is formed at the other end of the yoke 44 so as to be engaged with the pin 47*a* so that the one end of the connecting member 47 is rotatably coupled to the yoke 44. In addition, although the engagement structure between the yoke 44 and the central disk 26 is not seen well by being hidden by the bracket 31 in FIG. 3, as can be seen in FIG. 4 showing the engagement structure between the yoke 44 and the central disk 26 when viewed from the back of the bracket 31, a pin 45*a* is formed at one end of a connecting member 45 and a hole 44*a* is formed at a corresponding position of the yoke 44 so as to be engaged with the pin 45*a* so that the one end of the connecting member 45 is rotatably coupled to the yoke 44.

As such, in the above embodiment, although it has been illustrated that the pins 45*a*, 46*a* and 47*a* are formed at the connecting members 45, 46 and 47, respectively, and the holes 44*a*, 44*b* and 44*c* are formed at the yoke 44 so as to be rotatably engaged with the pins 45*a*, 46*a* and 47*a*, it will be obvious to a person of ordinary skill in the art, that a vice-versa case, i.e., the case where holes are formed at the connecting members 45, 46 and 47, respectively, and pins are formed at the yoke 44 so as to be rotatably engaged with the holes of the connecting members 45, 46 and 47 also falls within the scope of the present disclosure.

Although not shown in the drawings, the engagement between the pin 45*a*, 46*a* and 47*a* of the connecting member 45, 46 and 47 and the holes 44*a*, 44*b* and 44*c* of the yoke 44 is preferably achieved by means of bearings for the sake of smooth rotation therebetween. Moreover, based on the application, additional means such as a semi-bonded bushing may be installed to overcome dimension variances and/or position variances during operation.

In this embodiment, the connecting members 46 and 47 connected to the eccentric shafts 41 and 42 includes cover disks 46*b* and 47*b* that cover and fix the ends of the eccentric shafts 41 and 42, and extensions 46*c* and 47*c* that extend outwardly from the cover disks 46*b* and 47*b*, but the present disclosure is not limited thereto.

As shown in FIG. 5, in addition to the above-described yoke 44, an extra yoke 48 may be additionally provided at an opposite side to a side of the two eccentric shafts 41 and 42 where the yoke 44 is mounted so that the extra yoke 48 can be connected to the two eccentric shafts 41 and 42, respectively, by means of the two connecting members 46 and 47. The engagement structure between the extra yoke 48 and the connecting members 46 and 47 is similar to that between the yoke 44 and the connecting members 46 and 47, and thus a detailed description thereof will be omitted to avoid redundancy. The use of the extra yoke 48 helps in ensuring proper start-up of the eccentric assembly 30 and stabilizes the movement speed of the eccentric shafts 41 and 42. Preferably, the extra yoke 48 is shifted in phase relative to the yoke 44 (as shown in FIGS. 3 and 5) to prevent jamming of the mechanism during the start-up in every possible position.

As the yoke 44 and the extra yoke 48 are connected to each of the connecting members 45, 46 and 47 at a distance from each of the corresponding rotational axes 26*a*, 41*a* and 42*a*, vibration associated with this eccentricity may occur when the connecting members 45, 46 and 47 rotate. In order to reduce this undesirable vibration, as shown in FIG. 6, at least one of the connecting members 45, 46 and 47 can be configured to have counter weight 45*d*, 46*d* and 47*d* at one end opposite to the end connected to the yoke 44 or the extra yoke 48. The counter weight 45*d*, 46*d* and 47*d* may be coupled to the connecting members 45, 46 and 47 or maybe integrally formed with the connecting members 45, 46 and 47.

As described above, since the eccentric assembly 30 according to the present disclosure does not employ the toothed belts that are wearable and is not reliable unlike the conventional eccentric assembly as shown in FIG. 7, it will greatly reduce risk of failure, servicing time and its frequency, which in turn will save time and money. It will be beneficial for machine owner and people responsible for road construction since a more reliable mechanism will provide better compaction and in the end, better quality of road surfaces. It will also increase the quality of work performed by an operator since it will ensure reliable oscillation functionality and proper compaction.

In addition, as can be seen from the comparison between the eccentric assemblies of FIGS. 2 and 6, the present disclosure will be quite easy for implementation and potential servicing since the eccentric assembly 30 is located in the same place as the previous solution and uses simple, easy-to-produce components. Using metal elements also will be more environment-friendly since we will have a recyclable component that can last much longer instead of having the difficult-to-recycle rubber toothed belt that needs to be frequently replaced. Since there will be much less energy losses due to deformation of the rubber toothed belt, it will dissipate less energy and thus be more fuel-efficient.

In short, the present disclosure provides an eccentric assembly for oscillating a compacting drum of a compacting machine, which can provide greater reliability and much logger lifetime to allow less serviceability to be needed, can eliminate the necessity for wearable belts to make a design simple while offering a more environment-friendly solution, and can be easily implemented in the conventional compacting machine using the toothed belts.

Although the invention has been described with reference to the preferred embodiments in the attached figures, it is noted that equivalents may be employed and substitutions made herein without departing from the scope of the invention as recited in the claims.

The invention claimed is:

1. An eccentric assembly for oscillating a compacting drum of a compacting machine, the eccentric assembly comprising:

a central disk rotatably mounted to the compacting drum to have an axis disposed in juxtaposition with an axis of the compacting drum, and configured to be rotatably driven by a motor;

a pair of opposed eccentric shafts, each axis of which is disposed equidistantly from the center of the axis of the central disk, the eccentric shafts being rotatably mounted to the compacting drum such that the three axes of the central disk and the eccentric shafts are in the same plane; and a yoke disposed between the central disk and the two eccentric shafts in such a manner as to be connected to the central disk and the two eccentric shafts, respectively, by means of three connecting members, wherein one end of each of the connecting members is rotatably coupled to different positions of the yoke, and the other end thereof is fixed to a corresponding one of the central disk and the two eccentric shafts such that the two eccentric shafts rotate synchronously by the rotation of the central disk.

2. The eccentric assembly for oscillating a compacting drum of a compacting machine as claimed in claim 1, wherein a pin is formed at one end of at least one of the connecting members, and a hole is formed at one end of the yoke so as to be engaged with the pin so that the at least one connecting member is rotatably coupled to the yoke.

3. The eccentric assembly for oscillating a compacting drum of a compacting machine as claimed in claim 1, wherein the one end of at least one of the connecting members is coupled to the yoke by means of a bearing.

4. The eccentric assembly for oscillating a compacting drum of a compacting machine as claimed in claim 1, wherein at least one of the connecting members connected to the eccentric shafts among the three connecting members, comprises a cover disk configured to cover and fix the end of at least one of the eccentric shafts, and an extension extending outwardly from the cover disk.

5. The eccentric assembly for oscillating a compacting drum of a compacting machine as claimed in claim 1, further comprising an extra yoke disposed at an opposite side to a side of the two eccentric shafts where the yoke is mounted such that the extra yoke is connected to the two eccentric shafts, respectively, by means of two connecting members.

6. The eccentric assembly for oscillating a compacting drum of a compacting machine as claimed in claim 1, wherein at least one of the connecting members are configured to have counter weight at one end opposite to the end connected to the yoke or the extra yoke.

7. The eccentric assembly for oscillating a compacting drum of a compacting machine as claimed in claim 5, wherein the extra yoke is shifted in phase relative to the yoke.

8. The eccentric assembly for oscillating a compacting drum of a compacting machine as claimed in claim 1, wherein the central disk is rotatably mounted to a bracket that extends in a radial direction of the compacting drum and is fixed to the compacting drum.

9. The eccentric assembly for oscillating a compacting drum of a compacting machine as claimed in claim 1, wherein each of the two eccentric shafts are rotatably mounted at both ends thereof to two section walls that extend in a radial direction of the compacting drum and is fixed to the compacting drum.

10. A compacting drum comprising the eccentric assembly as claimed in claim 1.

11. A construction vehicle comprising the compacting drum as claimed in claim 10.

* * * * *